United States Patent [19]

Lawler

[11] 3,931,828

[45] Jan. 13, 1976

[54] FLUSHING ACCESSORY FOR OUTBOARD MOTORS

[75] Inventor: Roger J. Lawler, Lakewood, Calif.

[73] Assignee: Quik-N-Easy Products, Inc., Monrovia, Calif.

[22] Filed: Jan. 2, 1975

[21] Appl. No.: 538,039

[52] U.S. Cl. ..... 134/167 R; 134/169 A; 134/199

[51] Int. Cl.[2] ..... B08B 3/02; B08B 9/00

[58] Field of Search ..... 134/166 R, 167 R, 168 R, 134/169 A, 172, 199

[56] References Cited

UNITED STATES PATENTS

| | | | |
|---|---|---|---|
| 1,799,525 | 4/1931 | Morgan | 134/167 R |
| 2,005,385 | 6/1935 | O'Hara | 134/167 R X |
| 2,408,958 | 10/1946 | Smith | 134/167 R X |
| 2,611,631 | 9/1952 | Benson | 134/167 R X |
| 2,620,812 | 12/1952 | Kiefer | 134/169 A UX |
| 2,644,474 | 7/1953 | Houchin | 134/166 R |
| 3,134,388 | 5/1964 | Peloso | 134/166 R |

*Primary Examiner*—Robert L. Bleutge
*Attorney, Agent, or Firm*—Sellers and Brace

[57] ABSTRACT

A self-gripping flushing accessory quickly attachable over the water inlet of an outboard motor without need for fasteners while flushing the engine cooling passages from a garden hose or the like source of water. The accessory straddles and resiliently grips the opposite sides of the engine drive shaft housing in the area surrounding the usual water intake opening.

6 Claims, 5 Drawing Figures

FLUSHING ACCESSORY FOR OUTBOARD MOTORS

This invention relates to a simply constructed water flushing accessory readily attachable without tools over the water inlet openings of an outboard motor.

Outboard marine engines are typically provided with water cooling passages having an inlet located along the submerged portions of the propeller drive shaft housing and which passages discharge rearwardly adjacent the propeller. Oftentimes it is desirable to operate the engine on land for tuning or adjusting purposes and it is also desirable to flush the cooling passages with fresh water after use of the engine in open water. These needs commonly have been met by mounting the engine along the inner rim of a barrel filled with water, a practice which has obvious disadvantages including cost, inconvenience and creating storage problems when not in use. In attempts to circumvent these disadvantages a flushing expedient has been proposed comprising a pair of separate plates adapted to be clamped astride the drive shaft housing by means of two pairs of bolts and includes provision for connecting a hose to its water inlet. This device is cumbersome, excessively large, costly and requires tools for its attachment and detachment.

By this invention there is provided an improved, inexpensive, rugged flushing assessory which is instantly attachable to and removable from the drive shaft housing merely by pushing it astride this housing. The device has a generally rigid but resilient main body the legs of which can be expanded to straddle the drive shaft housing and includes a pair of self-gripping, resilient fittings which press frictionally against the opposite sides of the housing to seal against and grip these surfaces. One of the resilient fittings is provided with a coupling for attaching a garden hose to the accessory to flood the intake openings and the water pump intake. The engine may then be operated in the normal manner to flush the cooling passages with clean water or to supply cooling fluid while the engine is being operated on land. After use, the device is simply withdrawn and stored until needed.

Accordingly, a primary object of the invention is the provision of a simple, rugged, self-gripping flushing accessory for supplying the cooling passages of an outboard motor with water from a garden hose.

Another object of the invention is the provision of a unitary, self-gripping flushing accessory attachable over the water inlets of an outboard motor without need for tools or fasteners.

Another object of the invention is the provision of a flushing accessory for outboard marine engines having a unitary U-shaped main body supporting resilient self-gripping sealing members facing toward one another from the free ends of its legs and effective to grip and hold the accessory frictionally assembled to the engine drive shaft housing and including a coupling for attaching a water supply hose to the accessory.

These and other more specific objects will appear upon reading the following specification and claims and upon considering in connection therewith the attached drawing to which they relate.

Referring now to the drawing in which a preferred embodiment of the invention is illustrated:

Figure 1:
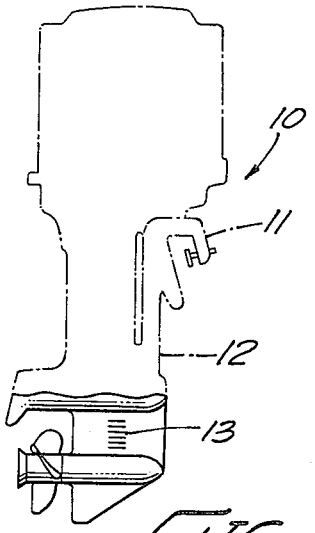
FIG. 1 is a side elevational view of a typical outboard marine engine.

Referring more particularly to FIG. 1, there is shown a typical outboard engine 10 provided with clamping means 11 for securing the engine to a boat transom with the propeller drive shaft housing 12 located rearwardly of the transom. The opposite flattened sides of housing 12 are customarily provided with grill-protected water inlets 13 along the opposite faces thereof. Inlets 13 and a clear showing of the contour of adjacent portion of the drive shaft housing is best shown in FIG. 3.

Figure 2:
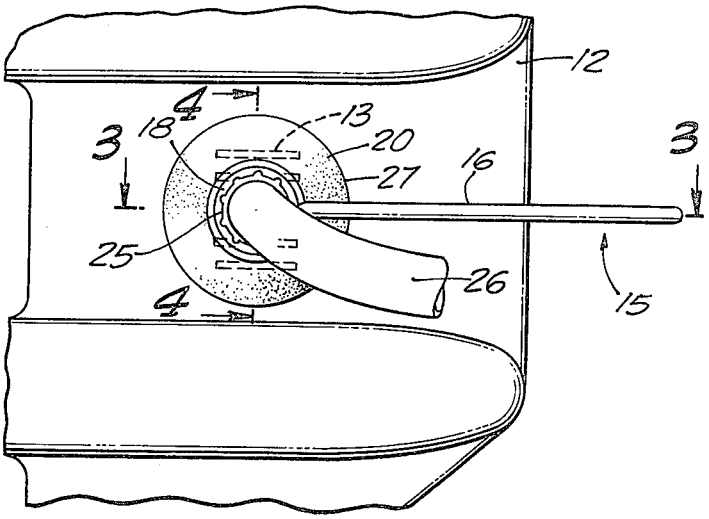
FIG. 2 is a fragmentary enlarged view of one side of the engine drive shaft housing showing the flushing accessory in operating position over the cooling water inlets.
Figure 3:
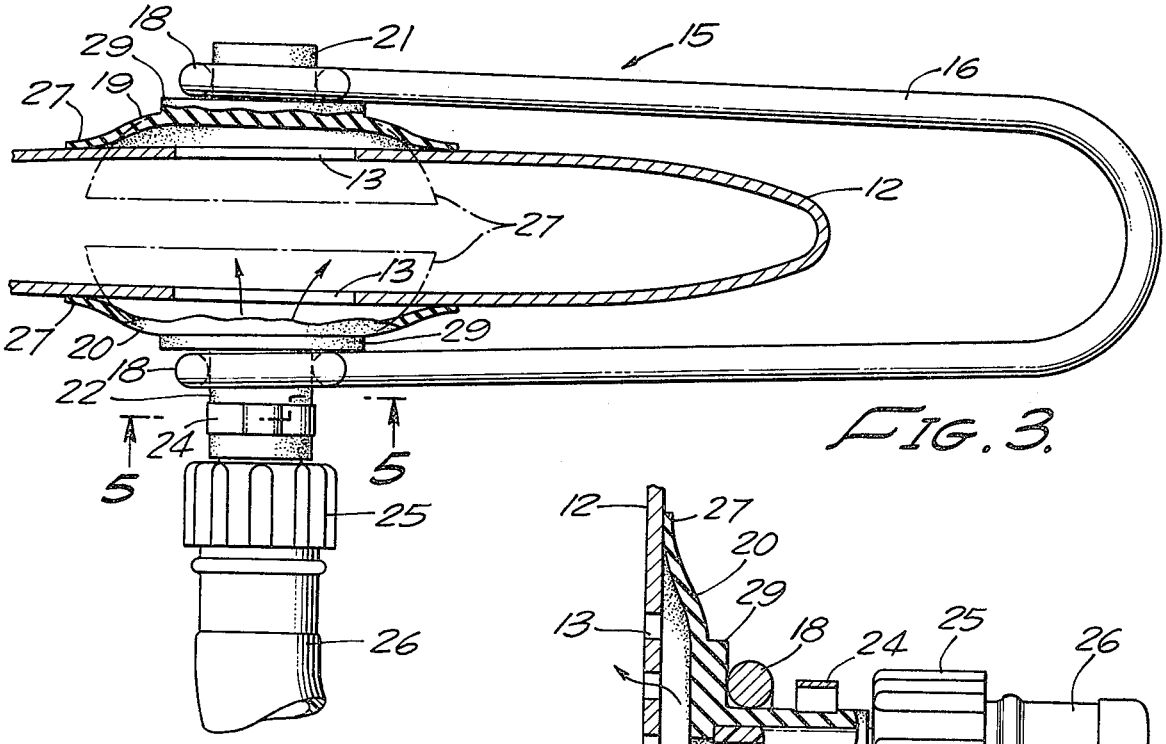
FIG. 3 is a fragmentary cross-sectional view on a still larger scale taken along line 3—3 on FIG. 2.
Figure 5:
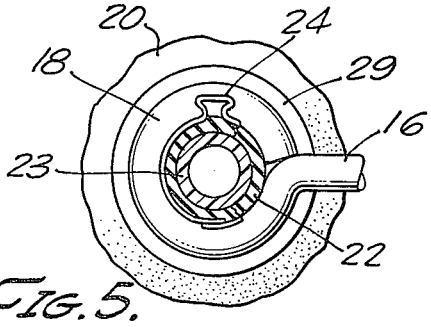
FIG. 5 is a fragmentary cross-sectional view taken along line 5—5 on FIG. 3.

An illustrative embodiment of the invention flushing accessory, designated generally 15, is shown in FIGS. 2 and 3. Preferably, the accessory has a one-piece U-shaped mainbody 16 formed from any suitable material as, for example, rigid resilient rod stock. The spacing between the legs is somewhat greater than the transverse thickness of housing 12. The free ends of the legs of member 16 are formed with an eyelet 18 best shown in FIG. 5. Each eyelet snugly grips and retains in place therein a separate resilient gripping and sealing member 19,20. These members are made of supple tough elastomeric material and, as here shown by way of example, have a generally cup-shaped main body formed with an integral circular boss 21,22. These bosses extend through a respective one of the eyelets 18 with a sufficient interference fit to retain them firmly assembled to the associated one of eyelets 18. Boss 21 is solid but boss 22 is tubular to receive one end half of a hose coupling 23 which is held clamped in place in boss 22 by a clamp 24. The hose coupling includes a typical threaded clamping ring 25 engageable with the threads of the other coupling half secured to the end of a garden hose 26.

Figure 4:
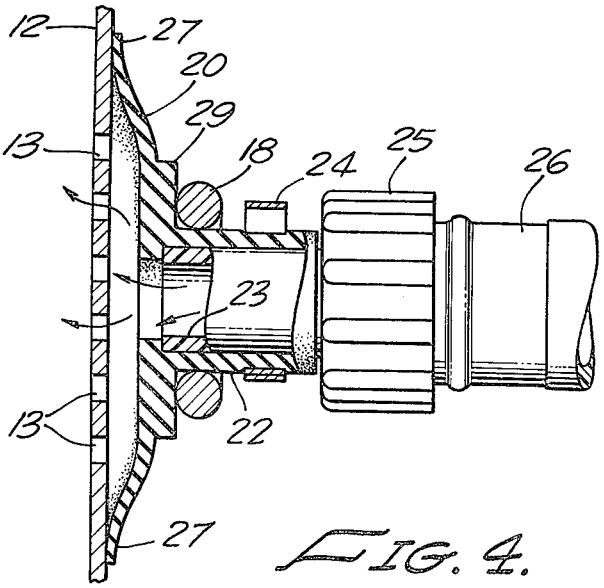
FIG. 4 is a fragmentary cross-sectional view of the water inlet side of the flushing accessory taken along line 4—4 on FIG. 2.

As is clearly shown in FIGS. 2, 3 and 4, the resilient sealing and gripping members 19 and 20 have relatively thin flexible rims 27 normally occupying the relaxed positions represented in dot and dash lines in FIG. 3. However, when the sealing members are forced to expand as they are piloted over the converging lateral edge of the drive shaft housing 12, these members are expanded to the shape illustrated in full lines in FIG. 3, this expansion and spreading occurring as these members approach the fully assembled position over water inlets 13.

It will be noted that the body of the central area of sealing members 19,20 is substantially thicker to stiffen and reinforce these members in the area surrounding bosses 21,22 to avoid any possibility of the sealing members collapsing or tending to invert. Thus, referring to FIG. 4 it will be noted that each member includes a low height large diameter boss 29 having its outer end surface bearing directly against eyelet 18. This boss extends radially over a substantial area of sealing member 20.

In use and with the engine suitably supported out of water and in an upright position, the flushing device 15 with its attached hose 26 is installed simply by shifting the open end of the U-shaped main body 16 horizontally astride drive shaft housing 12 from the right hand lateral edge thereof as shown in FIG. 1. The device is advanced until the sealing and gripping members 19,20 embrace and enclose the water inlets 13. Water is now supplied through hose 26 and the engine may be started and its cooling passages thoroughly flushed with clean water or the engine may be safely operated for as long as desired. As soon as the flushing operation has been completed the user merely withdraws the flushing accessory and stores it until again needed.

While the particular flushing accessory for outboard motors herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A self-gripping flushing accessory quickly attachable to and detachable from the cooling water intake openings of an outboard marine engine without need for tools or fasteners while flushing the engine cooling passages, said accessory having a U-shaped main body equipped between the free ends of the legs thereof with resilient sealing means facing toward one another, at least one of said resilient sealing means being provided with a water flow passage readily connectable to a source of water, said U-shaped main body being sized to straddle the engine drive shaft housing with the legs of said main body holding said resilient sealing means seated over a respective one of said cooling water inlets with a snug substantially water-tight self-gripping fit whereby the engine water circulating pump is operable to circulate cooling and flushing water through the engine cooling passages without need for submerging said engine cooling water inlets in a body of water.

2. An engine flushing accessory as defined in claim 1 characterized in that said U-shaped main body is formed in one piece from rigid resilient material with the legs thereof generally parallel to one another.

3. An engine flushing accessory as defined in claim 1 characterized in that said resilient sealing means provided with said water flow passage includes one part of a two-part separable hose coupling to facilitate connecting the water passage of said accessory to a source of water via a hose or the like.

4. An engine flushing accessory as defined in claim 1 characterized in that said U-shaped main body is resilient and shaped to hold said resilient sealing means firmly pressed against the opposite surfaces of the engine propeller shaft housing and adjacent the portions thereof surrounding the adjacent one of said cooling water inlets.

5. An engine flushing accessory installable without need for tools or fasteners over the dual cooling water inlets of an outboard motor and adapted to be held temporarily and frictionally assembled thereto while the engine is being operated out of the water, said accessory comprising a U-shaped main body of rigid material, sealing means of elastomeric material mounted between the free ends of the legs of said main body and cooperable therewith to hold said accessory frictionally and firmly assembled astride the engine propeller shaft housing with said sealing means covering a respective one of said water inlets and firmly gripping the juxtaposed surface of said housing, and one of said sealing means including a water flow passage connectable to a source of water thereby to supply water to the engine while being operated out of the water.

6. An accessory as defined in claim 5 characterized in that said sealing means with a water flow passage is cup-shaped with the concavity thereof facing toward the adjacent surface of the other one of said sealing means.

* * * * *